US005421799A

United States Patent [19]

Rabin et al.

[11] Patent Number: 5,421,799

[45] Date of Patent: Jun. 6, 1995

[54] SCALP MASSAGER

[76] Inventors: Gustavo R. Rabin, 4927 Rhodes Ave.; Pablo Trench, 12419 Huston St., both of Valley Village, Calif. 91607

[21] Appl. No.: 283,808

[22] Filed: Aug. 1, 1994

[51] Int. Cl.[6] ..... A61H 1/00

[52] U.S. Cl. ..... 601/71; 601/79; 601/46; 2/410; 2/422

[58] Field of Search ..... 602/74; 606/204, 204.15, 606/201; 601/70, 71, 78, 79, 12, 17, 101, 103, 134, 136; 2/410, 411, 414, 422

[56] References Cited

U.S. PATENT DOCUMENTS

| | | | |
|---|---|---|---|
| 849,844 | 4/1907 | Laurence | 601/136 |
| 2,049,434 | 8/1936 | Erickson | 601/136 |
| 2,123,418 | 7/1938 | Crosley et al. | 601/12 |
| 2,467,007 | 4/1949 | Boyd | 601/103 |
| 2,657,684 | 11/1953 | Avery | 601/17 |
| 3,665,514 | 5/1972 | Durand | 2/422 X |
| 3,763,853 | 10/1973 | Jochimski | 601/70 |
| 4,469,092 | 9/1984 | Marshall et al. | 601/70 |
| 4,675,919 | 6/1987 | Heine et al. | 2/410 |
| 4,765,316 | 8/1988 | Marshall | 601/70 |
| 5,115,769 | 5/1992 | Fiorini | 601/71 |

FOREIGN PATENT DOCUMENTS

| | | | |
|---|---|---|---|
| 477790 | 4/1992 | European Pat. Off. | 601/70 |
| 1169266 | 12/1958 | France | 601/71 |
| 2107193 | 4/1983 | United Kingdom | 2/410 |
| 79000974 | 11/1979 | WIPO | 601/103 |

*Primary Examiner*—Michael A. Brown
*Assistant Examiner*—Brian E. Hanlon
*Attorney, Agent, or Firm*—Jack C. Munro

[57] ABSTRACT

A scalp massager which utilizes a rigid but yet bendable main supporting frame which is to be mounted on a human head and extend from the nape to the forehead. A vibrator is to be mounted exteriorly on the main supporting frame. Interiorly mounted on the main supporting frame is a parietal pad assembly with there also being mounted a temporal pad assembly and an occiput pad assembly mounted on the main supporting frame. Each of these pad assemblies are designed to come into contact with the corresponding areas of a human head. Each of these pad assemblies is designed to be adjustable on the main supporting frame so as to accommodate different sizes of human heads.

3 Claims, 3 Drawing Sheets

SCALP MASSAGER

BACKGROUND OF THE INVENTION

1. Field of the Invention

The field of this invention relates to scalp massaging apparatuses and more particularly to a self contained scalp massager which is designed to simultaneously apply a therapeutic massaging effect to the temple areas, the parietal area and the occiput area of the human head.

2. Description of the Prior Art

Massaging the scalp of a human being is an exceedingly old technique for several reasons. One reason is that a scalp massage induces relaxation thereby relieving stress. Another reason is that a scalp massage induces blood circulation thereby generally improving the scalp tissues. Also, a scalp massage has a therapeutic effect to stimulate hair growth and to encourage new hair growth.

There have been numerous prior art patents which function to massage the scalp in different ways. However, many of these devices have not been portable in that they are to be connected to a jet of water or part of a rather large machine which would require the user to remain stationary at a given location. However, there have been constructed some portable devices which are adapted to move along with the user. However, these devices have been far too complex which is not necessary to produce an effective scalp massager. Also, complexity increases the expense of manufacture which significantly increases the cost of such a scalp massager to the user.

SUMMARY OF THE INVENTION

The primary objective to the present invention is to construct a scalp massager which is portable so as to be movable along with the user, which is composed of few parts, but yet applies a vibrational massaging technique simultaneously to not only the forward area of the scalp but also the top area of the scalp and the rear area of the scalp.

Another objective of the present invention is to construct a scalp massager which can be readily adjusted to accommodate any size scalp eliminating the need to manufacture different sizes of scalp massagers.

Another objective of the present invention is to construct a scalp massager to be of minimal complexity thereby minimizing its manufacturing expense so that it can be sold to the consumer at a reasonable price.

The scalp massaging apparatus of the present invention utilizes a thin strip like main supporting frame which is formed in an arcuate shape. Mounted on the exterior of this frame is a vibration generating apparatus which creates vibration by an electrical motor being operated by batteries. Interiorly mounted on the frame is a parietal pad assembly which is to be placed against the top of the head. This parietal pad assembly is adjustable along the longitudinal length of the supporting frame. The parietal pad assembly is cantileverly mounted to exert a continuous bias against the human head. The parietal pad assembly includes a resilient pad to provide a soft surface in direct contact with the human head. Mounted at the front end of the scalp massager is a temporal pad assembly which includes a pair of temporal pads mounted on a crosspiece which is adjustably mounted on the main supporting frame. The temporal pad assembly also includes temporal pad members with there being one member mounted at one end of the crosspiece and another member mounted at the opposite end of the crosspiece. These members are longitudinally adjustable on the crosspiece as well as being pivotable. At the rear end of the main supporting frame is mounted a second crosspiece which is again longitudinally adjustable on the frame. At each end of the second crosspiece is again mounted a pad with this pad being longitudinally adjustable and pivotable on this crosspiece. These pads are to be in contact with the occiput of the head directly adjacent the nape.

DETAILED DESCRIPTION OF THE SHOWN EMBODIMENT

Figure 8:
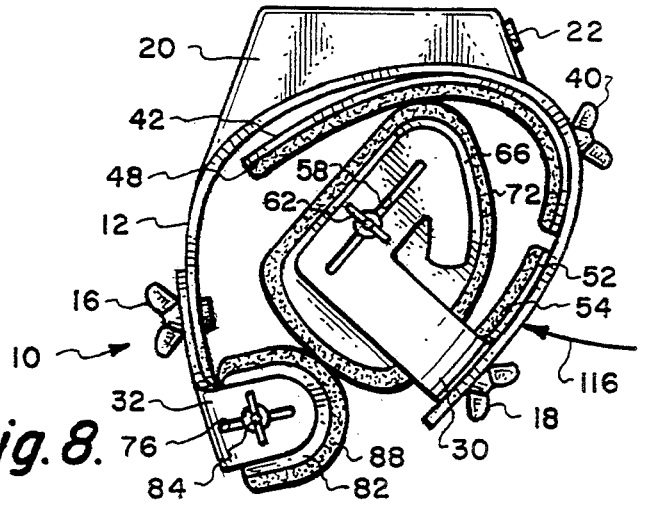
FIG. 8 is a side elevational view of the scalp massaging apparatus of the present invention showing the scalp massaging apparatus at an at rest position not mounted on a human head.

Referring particularly to the drawings, there is shown the scalp massaging apparatus 10 of this invention. The scalp massaging apparatus 10 comprises a main supporting frame 12 which is basically rigid and generally formed of plastic. This main supporting frame has the general shape of a thin strap which in side view has a general arcuate configuration. Actually, with the frame 12 at rest as is shown in FIG. 8, the frame 12 has a tendency to curl up on itself resembling the basic shape of a ball. When the frame 12 is then stretched into an arc, it has an inherent bias when placed on a human head tending to hold the frame 12 onto the human head.

The main supporting frame 12 has a front end which includes a slot 14. The main supporting frame 12 also has a rear end which has a hole that accommodates a wing nut fastener 16. Connecting with the slot 14 is a similar wing nut fastener 18.

Exteriorly mounted on the frame 12 located in between the fasteners 16 and 18 is a vibrating generating apparatus which has a plastic housing 20 which is integrally connected to the frame 12. Mounted on the exterior of the housing 20 is a variable speed switch 22 and a recharging socket 24. A recharger (not shown) is to be connectable to the socket 24 whose function is to recharge the batteries 26 mounted within the housing 20. The batteries 26 provide the electrical power to operate a small electrical motor 28. The electrical motor 28 includes an off-center weight mechanism (not shown) which when the motor 28 is operably driven imparts a vibration to the main supporting frame 12. This vibration of the frame 12 is transmitted to a temporal crosspiece 30 and an occiput crosspiece 32.

The temporal crosspiece 30 is mounted by fastener 18 to the main supporting frame 12 which engages with slot 14. There is included a slot hole 34 formed within the crosspiece 30. The longitudinal dimension of the slot 14 is in alignment with the longitudinal center axis 36 of the frame 12. This crosspiece 30 is to be adjustable to different positions according to the length of the slot 14 and when a desired particular position is achieved, the wing nut fastener assembly 18 is to be tightened and the crosspiece 30 maintained in that established position.

A similar adjusting procedure is provided for the occiput crosspiece 32 which includes an elongated slot 38 which is again longitudinally aligned with the longitudinal center axis 36. A locking device in the form of a wing nut fastener assembly 16 can be loosened to permit adjustment of the crosspiece 32 and once the desired position is obtained, the wing nut fastener assembly 16 is tightened.

Mounted interiorly of the main frame 12 by means of a wing nut fastener assembly 40 is a parietal pad member 42. This parietal pad member 42 is formed of rigid sheet material (generally plastic) and has an arcuate shape that is to conform generally to the parietal area 44 of the human head 46. This parietal pad member 42 has a resilient pad 48 fixedly mounted to the pad member 42. This resilient pad 48 will normally be constructed of rubber or rubberized plastic or could be a fabric such as felt. This pad 48 is to be in direct contact with the parietal area 44 of the human head 46. There is a tight interconnection established by wing nut fastener assembly 40 between the main supporting frame 12 and the pad member 42. There is adjustment provided for the pad member 42 by means of the wing nut fastener assembly 40 being movable in conjunction with a slot 50 formed within the main supporting frame 12. This slot 50 is in alignment with the longitudinal center axis 36. However, it is considered to be within the scope of this invention that the adjustment by slot 50 and wing nut fastener assembly 40 could be eliminated.

In between the wing nut fastener assembly 40 and the wing nut fastener assembly 18 and mounted on the inside surface of the main supporting frame 12 is a pad supporting member 52. This pad supporting member 52 is fixed to the crosspiece 30. Adhesively or otherwise fixedly secured to the pad supporting member 52 is a resilient pad 54 which is to come into contact with the forehead area 56 of the human head 46.

The opposite ends of the crosspiece 30 includes longitudinal slots 58 and 60. Connecting with slot 58 is a wing nut fastener assembly 62. In a similar manner connecting with the slot 60 is a wing nut fastener assembly 64. Wing nut fastener assembly 62 is mounted on a temporal pad member 66 with wing nut fastener assembly 64 being mounted on a temporal pad member 68. Mounted on the inside surface of the temporal pad member 68 is a resilient pad 70. In a similar manner mounted on the inside surface of the temporal pad member 66 is a resilient pad 72. Pad 72 is to rest against the right temple area of the human head 46 with the pad 70 resting against the left temple area of the human head 46. Both pad members 66 and 68 are longitudinally adjustable relative to their respective slots 58 and 60 as well as being pivotable by means of their respective fasteners assemblies 62 and 64. Once the desired position has been established, that position is again fixed by tightening of the fastener assemblies 62 and 64. This adjustment may be necessary so as to accommodate various sizes and shapes of heads 46. However, this adjustment may be eliminated with only pads 66 and 68 flexing and pivoting slightly relative to crosspiece 30.

Figure 5:
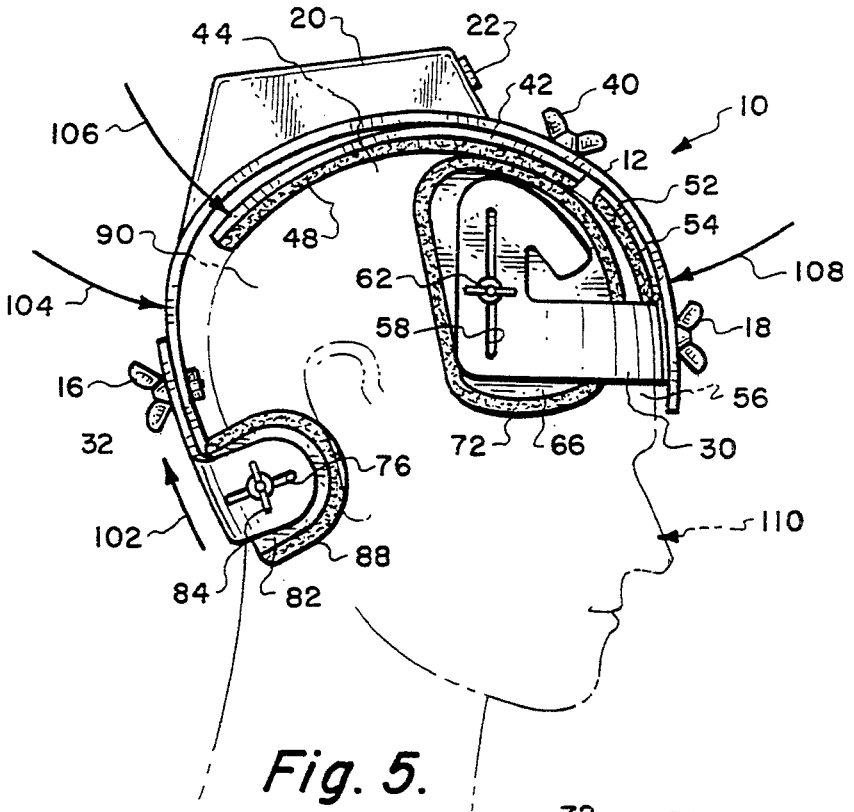
FIG. 5 is a right side elevational view similar to FIG. 1 but showing the scalp massaging apparatus of the present invention being mounted in conjunction with a smaller sized human head.

A different adjustment for a smaller head 110 is shown in FIG. 5. The occiput crosspiece is moved in the direction of arrow 102 and wing nut assembly 16 tightened. The main supporting frame 12 moves automatically in the direction of arrow 104 to the position shown. The parietal pad member 42 moves toward the parietal area 44 in the direction of arrow 106. The main supporting frame 12 also moves automatically toward the forehead area 56 in the direction of arrow 108.

It is to be understood that the vibration is to be transmitted through the main supporting frame 12 of the crosspiece 30 to each of the members 66 and 68 and through their respective pads 72 and 70 to be applied to the temple area of the human head 46. It is also to be understood that the member 42 exerts a constant bias by being cantileverly mounted by means of the fastener assembly 40 to ensure that the vibration is also transmitted through the pad 48 to the parietal area 44.

Figure 6:
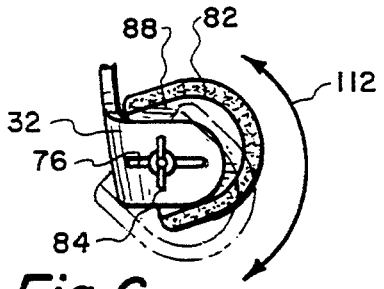
FIG. 6 is a view depicting one of the occiput pads of the scalp massaging apparatus of the present invention showing its pivotable adjusting movement to accommodate different sizes of heads.

On opposite sides of the crosspiece 32 there are included transverse slots 74 and 76. Mounted by wing nut fastener assembly 78 with slot 74 is an occiput pad member 80. A similar occiput pad member 82 is mounted by means of a wing nut fastener assembly 84 with the slot 76. Fixedly mounted to the inside surface of the pad member 80 is a resilient pad 86 with a similar resilient pad 88 being fixedly mounted to the inside surface of the pad member 82. The wing nut fastener assemblies 78 and 84, in conjunction with their respective slots 74 and 76, permit transverse adjustment of the pad members 80 and 82 on the crosspiece 32. This transverse adjustment is perpendicular to the longitudinal center axis 36. The resilient pads 86 and 88 are designed to rest against the occiput 90 of the human head 46 or 110. This adjustment of the pad members 80 and 82 is for the purpose of accommodating different sizes of human heads such as heads 46 and 110. Individual pivotable adjustment of pad members 80 and 82 is permitted as is depicted by arrow 112 in FIG. 6 for pad member 82. It is to be understood that vibration is to be readily transmitted from the main supporting frame 12 through the crosspiece 32 to the pad members 80 and 82 and hence through their resilient pads 86 and 88 to the occiput 90.

Figure 2:
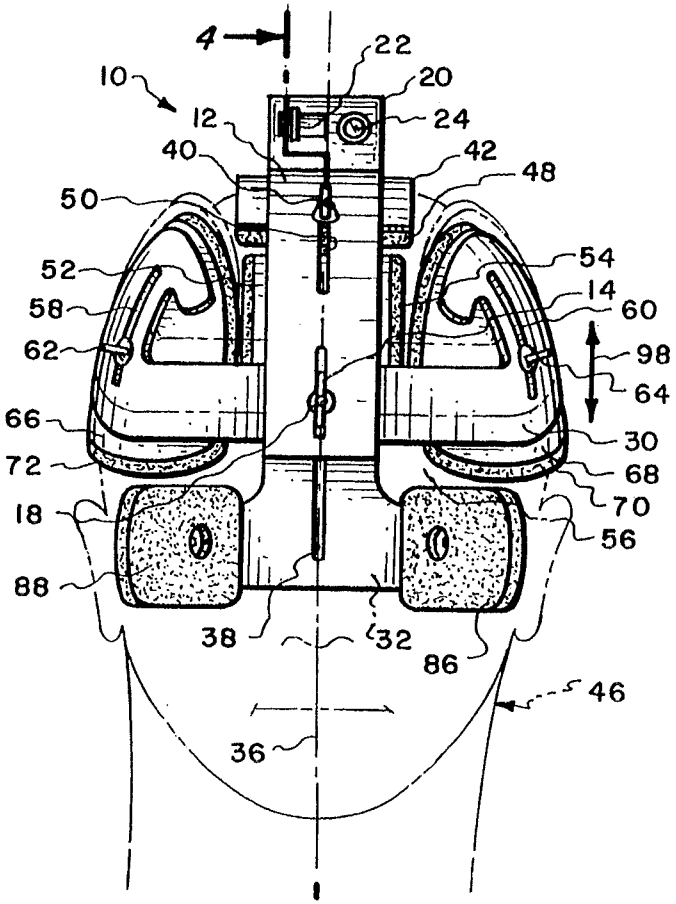
FIG. 2 is a front view of the scalp massaging apparatus of the present invention.
Figure 1:
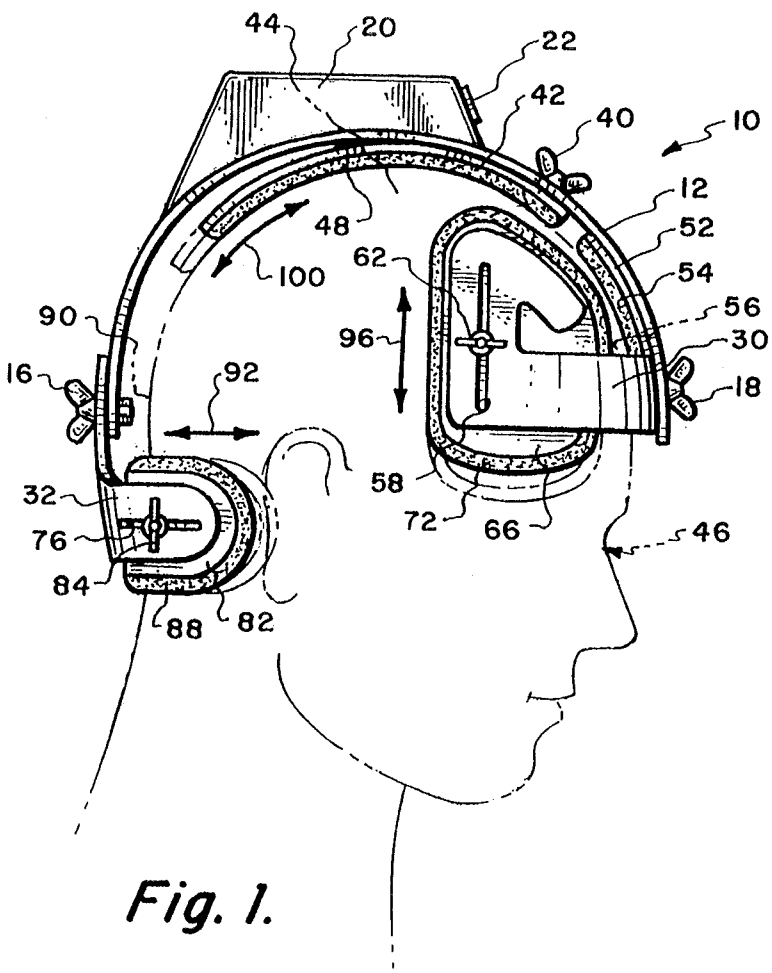
FIG. 1 is a right side elevational view of the scalp massaging apparatus of the present invention depicting such being mounted in conjunction with a normal or slightly large sized human head.
Figure 4:
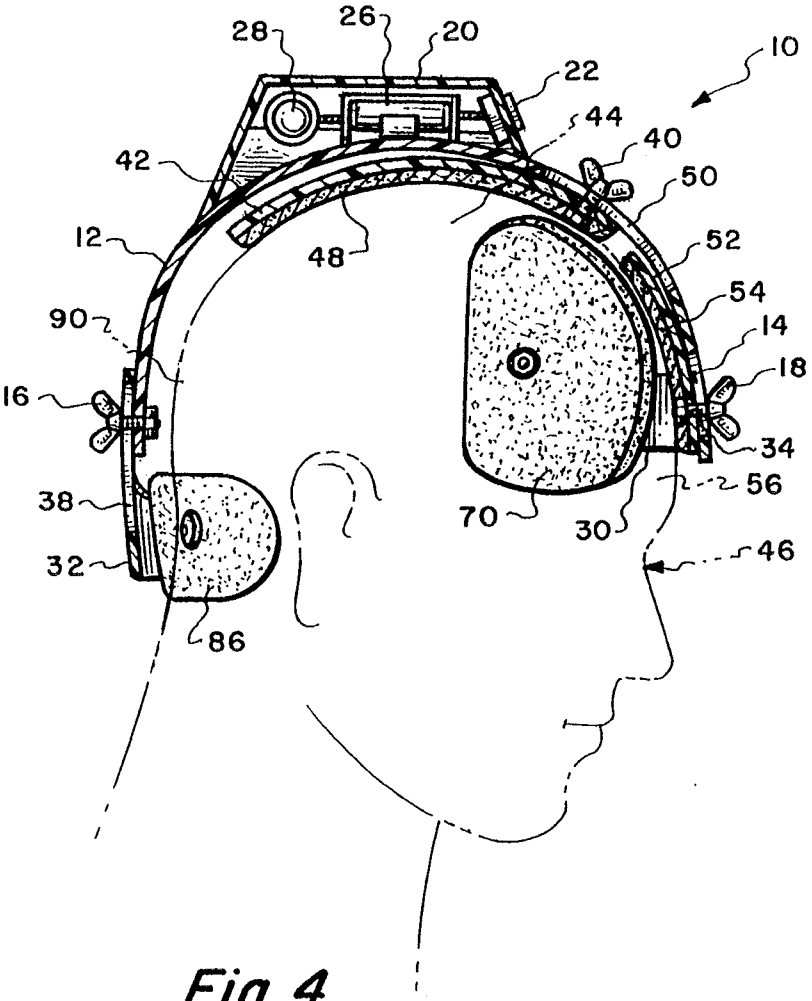
FIG. 4 is a cross sectional view of the scalp massaging apparatus of the present invention taken along line 4—4 of FIG. 2.
Figure 3:
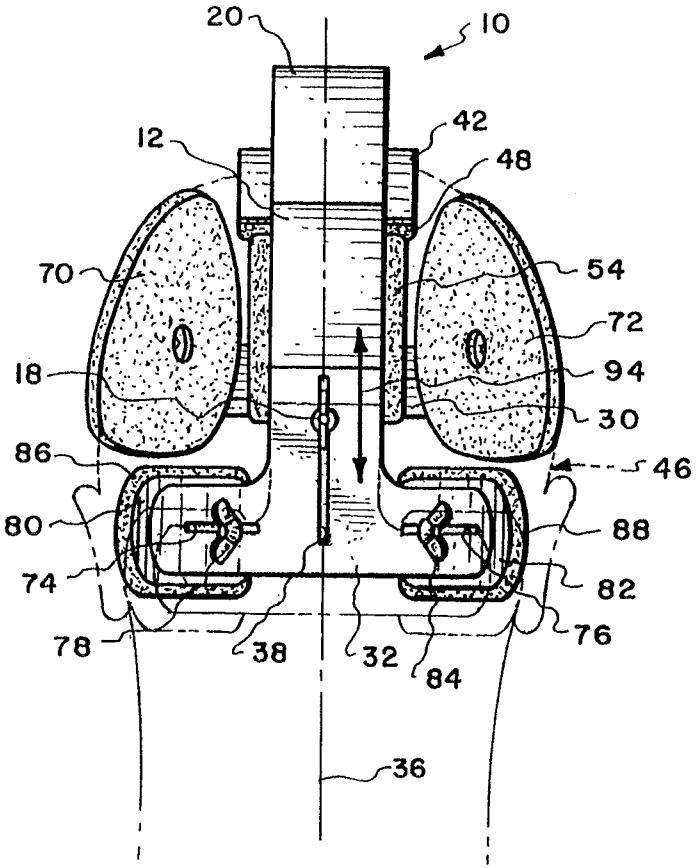
FIG. 3 is a rear view of the scalp massaging apparatus of the present invention.
Figure 7:
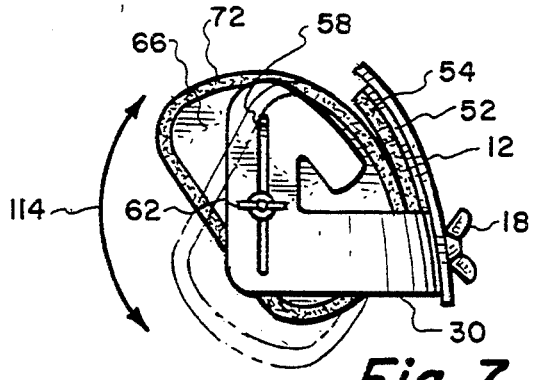
FIG. 7 is a depiction of a temporal pad member utilized within the scalp massaging apparatus of the present invention showing the pivotable adjustable movement of this pad member.

The transverse adjustment of the pad members 80 and 82 is depicted by arrow 92 in FIG. 1 shown adjacent the pad member 82. The longitudinal adjustment of the crosspiece 32 on the main supporting frame 12 is depicted generally by arrow 94 in FIG. 3. The longitudinal adjusting movement of the pad member 66 is depicted generally by arrow 96 in FIG. 1 with the longitudinal adjusting movement of the pad member 68 being depicted generally by arrow 98 in FIG. 2. The pad member 66 can also be pivotally adjusted about fastener assembly 62 as is shown by arrow 114 in FIG. 7. Similar adjustment is permitted of pad member 68. It is possible that the apparatus 10 could be constructed to eliminate the slots 74 and 76 and wing nut fastener assemblies 78 and 84 thereby only having adjustment by flexing of the pad members 80 and 82 on crosspiece 32.

The user will normally acquire the scalp massaging apparatus 10 of this invention in the collapsed at-rest position shown in FIG. 8. The user will physically expand the scalp massager 10 and will place such on his or her head. The user will then manually make the adjustments to comfortably locate the resilient pads 48, 86, 88, 72 and 70. Once a comfortable position is established, the appropriate fastener assembly will be tightened and that position will then be maintained. The user then only needs to activate the switch 22 which will initiate the vibration being supplied to all the aforementioned resilient pads which is then applied to the human head 46.

When the user does not wish to continue to use the scalp massager 10 of this invention, the switch 22 is moved to the off position which terminates the generating of vibrations. The user then is to connect the apparatus 10 of this invention to a charger unit, which is not shown, which connects to the charger socket 22.

What is claimed is:

1. A scalp massaging apparatus for a human head comprising:

a main supporting frame adapted to be placed on a human head and adapted to extend from the nape to the forehead, said main supporting frame being sufficiently rigid so as to transmit vibration, said main supporting frame assuming an arcuate shape adapted to conform to the parietal of a human head, said main supporting frame having a longitudinal center axis;

a vibration generating apparatus mounted on said main supporting frame;

a parietal pad assembly mounted on said main supporting frame, said parietal pad assembly being cantilevered on said main supporting frame thereby producing a bias which tightly is capable of pressing said parietal pad assembly into contact with the parietal of a human head, said parietal pad assembly including a resilient pad to abut against the human head, a rigid connection is established between said parietal pad assembly and said main supporting frame so as to transmit vibrations from said vibration generating apparatus to said parietal pad assembly;

a temporal pad assembly mounted on said main supporting frame, said temporal pad assembly being composed of at least two separate temporal pad members located in a spaced-apart manner with each said temporal pad member adapted to rest against a temporal area of a human head, each said temporal pad member including a resilient pad to abut against the human head, each said temporal pad member being mounted on a rigid temporal crosspiece, said rigid temporal crosspiece being rigidly mounted directly on said main supporting frame for permitting transfer of vibrations from said vibration generating apparatus to said temporal pad member; and an occiput pad assembly mounted on said main supporting frame, said occiput pad assembly being composed of at least two separate occiput pad members located in a spaced-apart manner with each said occiput pad member adapted to rest against the occiput area of the human head, each said occiput pad member including a resilient pad to abut against the human head said occiput pad assembly including a rigid occiput crosspiece which is connected directly to said main supporting frame, each said occiput pad member being mounted on said rigid occiput crosspiece.

2. The scalp massaging apparatus as defined in claim 1 wherein:

said rigid occiput crosspiece being adjustably mounted on said main supporting frame along a direction parallel to said longitudinal center axis.

3. The scalp massaging apparatus as defined in claim 2 wherein:

locking means for fixing said occiput crosspiece on said main supporting frame once a particular position is obtained of said occiput crosspiece on said main supporting frame.

* * * * *